US010651601B1

(12) United States Patent
Ho

(10) Patent No.: US 10,651,601 B1
(45) Date of Patent: May 12, 2020

(54) CONNECTING CABLE DEVICE WITH LOCK DEVICE

(71) Applicant: Oxti Corporation, Taipei (TW)

(72) Inventor: Chih Feng Ho, Taipei (TW)

(73) Assignee: Oxti Corporation, Taipei (TW)

( * ) Notice: Subject to any disclaimer, the term of this patent is extended or adjusted under 35 U.S.C. 154(b) by 0 days.

(21) Appl. No.: 16/438,730

(22) Filed: Jun. 12, 2019

(51) Int. Cl.
*H01R 13/639* (2006.01)

(52) U.S. Cl.
CPC ..... *H01R 13/639* (2013.01); *H01R 13/6397* (2013.01)

(58) Field of Classification Search
CPC ..... H01R 13/6397
See application file for complete search history.

(56) References Cited

U.S. PATENT DOCUMENTS 3,524,029 A * 8/1970 Laff ..... H01R 13/639 200/43.02
5,913,692 A * 6/1999 Targett ..... H01R 13/6397 439/367
6,485,316 B1 * 11/2002 Chen ..... H01R 13/6395 439/133
8,337,236 B2 * 12/2012 Shu ..... H01R 13/6395 439/369
9,231,344 B1 1/2016 Liao
9,270,038 B1 2/2016 Chao
9,431,746 B2 8/2016 Wu et al.
9,455,528 B1 9/2016 Chao
9,531,107 B1 * 12/2016 Baldwin ..... H01R 31/02

* cited by examiner

*Primary Examiner* — Tho D Ta
(74) *Attorney, Agent, or Firm* — Charles E. Baxley

(57) ABSTRACT

A connecting cable device includes a cable having two connectors attached to two end portions of the cable, and a lock device includes an elongated member, a casing formed on one end portion of the elongated member and having a chamber formed in the casing for engaging with the cable, a blocking member is engaged into the chamber of the casing for enclosing the chamber of the casing and for engaging with the cable and for retaining the cable in the chamber of the casing, and a fastening element is engaged with the casing and the blocking member for locking the blocking member to the casing and for preventing the blocking member from being disengaged from the casing.

6 Claims, 6 Drawing Sheets

CONNECTING CABLE DEVICE WITH LOCK DEVICE

BACKGROUND OF THE INVENTION

1. Field of the Invention

The present invention relates to a connecting cable device, and more particularly to a universal serial bus connecting cable device including one or more terminals or conductors or plugs attached or mounted or secured or coupled to the end portions of a cable for connecting or coupling to various electrical apparatuses or facilities or the electric power reservoirs or power sources or the like, and a lock device for fastening or locking the connecting cable device to the supporting member.

2. Description of the Prior Art

Typical universal serial bus connectors or various connecting cable device comprise a wire or cable, and one or more terminals or conductors or plugs attached or mounted or secured or coupled to the cable for connecting or coupling to various electrical apparatuses or facilities, such as personal computers, notebooks, docks, discs, mobile phones, portable phones, etc., and/or for connecting or coupling the selected or predetermined or required electrical apparatuses or facilities to the electric power reservoirs or power sources.

For example, the terminals or conductors or plugs of different types may be provided for connecting or coupling to the personal computers, notebooks, docks, discs, mobile phones, portable phones, or other or different types of electrical apparatuses or facilities, and/or for connecting or coupling the selected or predetermined or required electrical apparatuses or facilities to the electric power reservoirs or power sources.

For example, U.S. Pat. No. 9,231,344 B1 to Liao, U.S. Pat. No. 9,270,038 B1 to Chao, U.S. Pat. No. 9,431,746 B2 to Wu et al., and U.S. Pat. No. 9,455,528 B1 to Chao disclose several of the typical connectors for connecting or coupling to various electrical apparatuses or facilities, and each comprise one or more terminals or conductors or plugs attached or mounted or secured or coupled to the end portions of the cable for connecting or coupling to various electrical apparatuses or facilities or the electric power reservoirs or power sources or the like.

However, the typical connecting cable devices are normally randomly disposed on the supporting desk or table or platform or other supporting members and may be easily and quickly reached and obtained by any other persons; i.e., the typical connecting cable devices may not be fastened or locked for preventing the connecting cable devices from being stolen by the other unauthorized persons and the like.

The present invention has arisen to mitigate and/or obviate the afore-described disadvantages of the conventional connectors or terminals.

SUMMARY OF THE INVENTION

The primary objective of the present invention is to provide a connecting cable device including one or more terminals or conductors or plugs attached or mounted or secured or coupled to the end portions of a cable for connecting or coupling to various electrical apparatuses or facilities or the electric power reservoirs or power sources or the like, and a lock device for fastening or locking the connecting cable device to the supporting member.

In accordance with one aspect of the invention, there is provided a connecting cable device comprising a cable including two connectors attached to two end portions of the cable respectively, and a lock device including an elongated member having a first end portion and a second end portion, a casing provided on the first end portion of the elongated member and having a chamber formed in the casing for receiving and engaging with the cable, a blocking member engaged into the chamber of the casing for enclosing the chamber of the casing and for engaging with the cable and for retaining the cable in the chamber of the casing, and a fastening element engaged with the casing and the blocking member for locking the blocking member to the casing and for preventing the blocking member from being disengaged from the casing. The elongated member of the lock device may be fastened or locked to a supporting desk or table or platform or other supporting members for preventing the cable from being easily and quickly disengaged or separated from the casing and the supporting member and for preventing the cable from being easily and quickly stolen by the other unauthorized persons and the like.

The casing includes a base panel and a flap and an intermediate wall connected between the base panel and the flap for forming and defining the chamber in the casing, and the fastening element is engaged with the flap of the casing for locking the blocking member to the casing. The base panel is connected to the first end portion of the elongated member.

The casing includes a slot formed in the base panel and directed and opened away from the intermediate wall. The blocking member includes a projection extended therefrom for engaging with the slot of the casing and for anchoring the blocking member to the casing.

The blocking member includes a stop member extended from the projection, and stop member includes a standard greater than that of the projection and the slot of the casing for anchoring the blocking member to the casing, and for preventing the blocking member from being easily disengaged or separated from the casing inadvertently.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
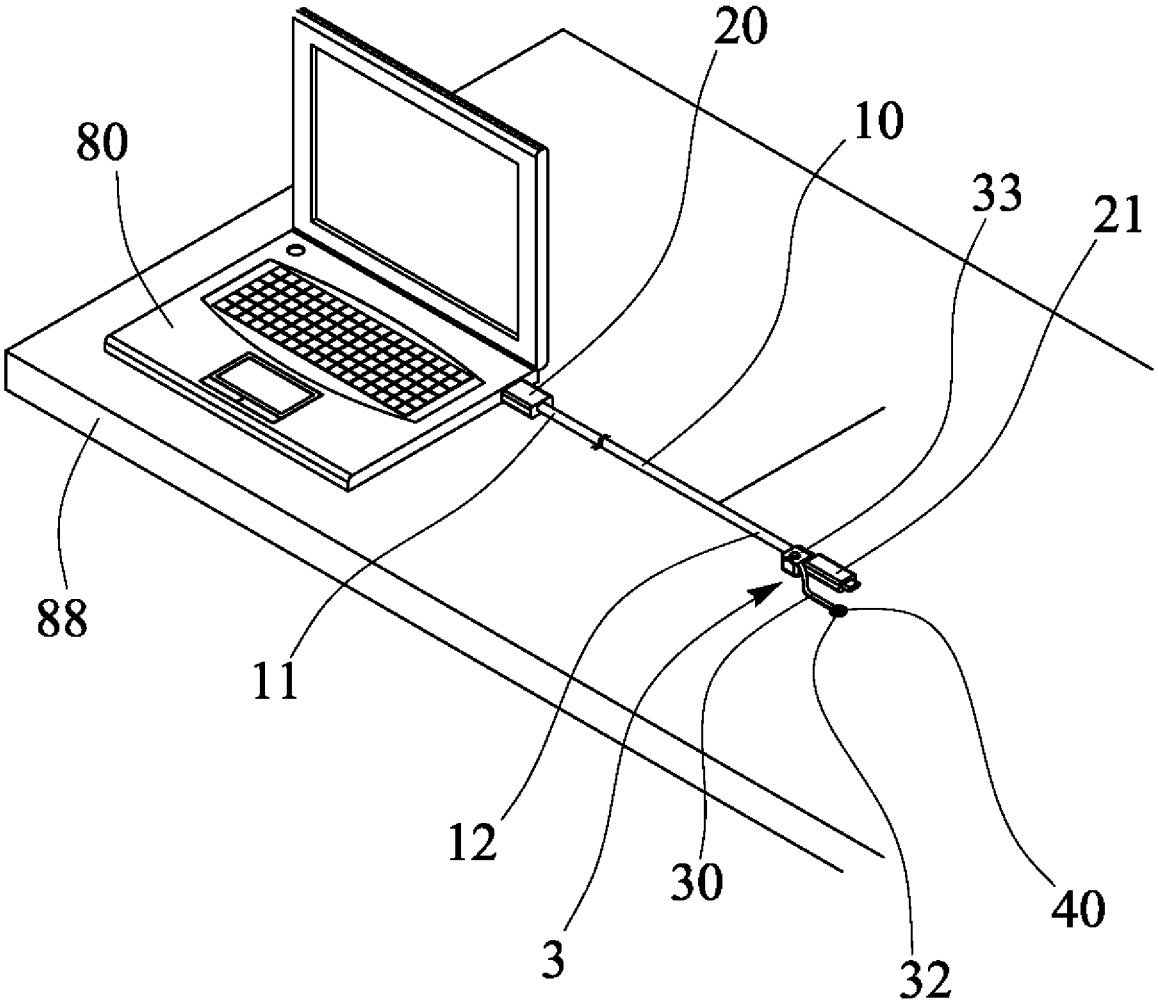
FIG. 1 is a perspective view illustrating the operation of a connecting cable device in accordance with the present invention.
Figure 2:
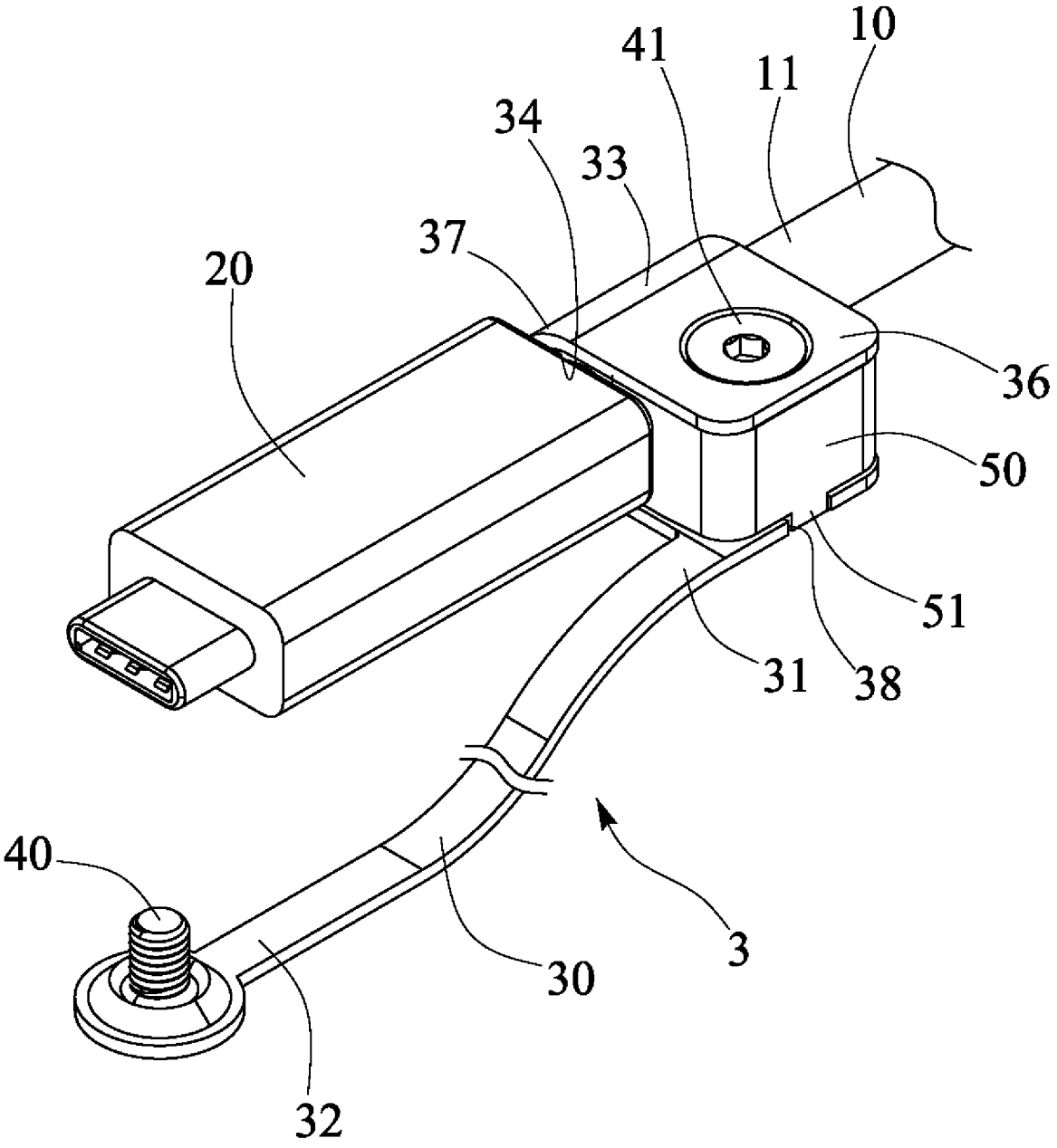
FIG. 2 is an enlarged partial perspective view of the connecting cable device.

Referring to the drawings, and initially to FIGS. 1 and 2, a connector assembly or connecting cable device in accordance with the present invention comprises a wire or cable 10 including one or more (such as two) end portions 11, 12, such as one or first end portion 11, and the other or second end portion 12, and one or more (such as two or first and second) terminals or plug members or connectors 20, 21 attached or mounted or secured or coupled to the end portions 11, 12 of the cable 10 for connecting or coupling to various electrical apparatuses or facilities, such as personal computers, notebooks 80 (FIG. 1), docks, discs, mobile phones, portable phones, electric power reservoirs, or power sources, batteries, etc. The connectors 20, 21 normally include a volume, diameter, size or standard greater than that of the cable 10.

The connectors 20, 21 may be selected from type A, type B, type C, or the like for connecting or coupling to various electrical apparatuses or facilities, such as personal computers, notebooks 80, docks, discs, mobile phones, portable phones, electric power reservoirs, or power sources, batteries, etc. The above-described structure or configuration for the connectors 20, 21 is typical and is not related to the present invention and will not be described in further details.

The connecting cable device in accordance with the present invention further comprises a lock device 3 for engaging with the cable 10 and for anchoring or retaining or locking the cable 10 to the supporting desk 88 (FIG. 1) or table or platform or other supporting members, the lock device 3 includes an elongated or longitudinal strap or wire or band or member 30 having one or first end portion 31, and another or second end portion 32, and a fastener or locking or fastening member 40 engaged with the second end portion 32 of the elongated member 30 and also engaged with the supporting member 88 for fastening or locking the lock device 3 and thus the cable 10 to the supporting member 88.

The lock device 3 further includes a housing or casing 33 formed or provided on the first end portion 31 of the elongated member 30 and having a compartment or chamber 34 formed therein for receiving or engaging with the cable 10 (FIGS. 1, 2), in which the chamber 34 of the casing 33 is formed or defined between or by a base panel 35 and a flap 36 that are preferably parallel to each other, and a middle or intermediate wall 37 connected or coupled between the base panel 35 and the flap 36, it is preferable, but not necessary that the base panel 35 is connected or coupled to the first end portion 31 of the elongated member 30, the casing 33 includes an oblong hole or slot 38 formed in the base panel 35 and located and directed and opened away from the intermediate wall 37.

Figure 3:
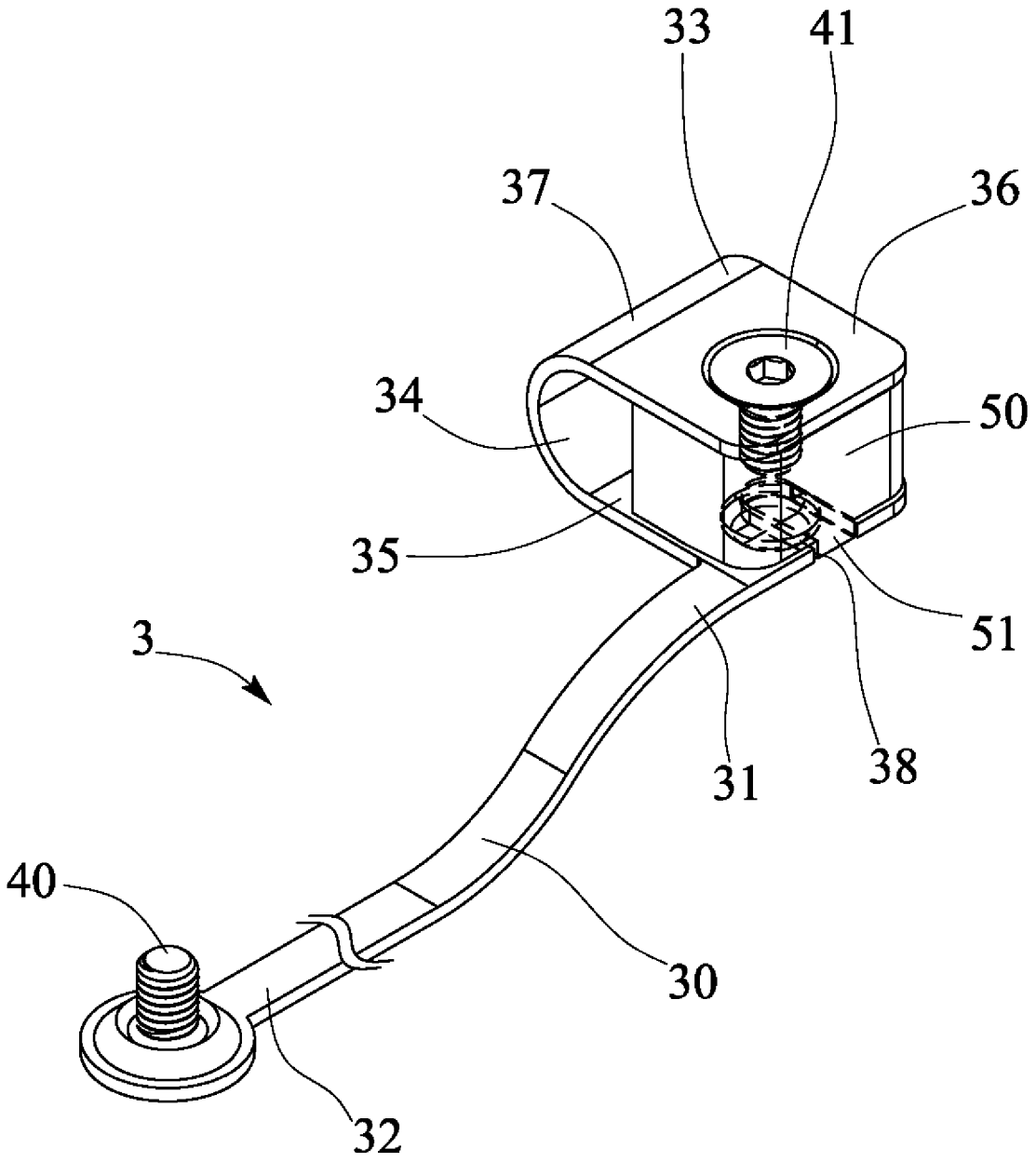
FIG. 3 is a further perspective view of the connecting cable device.
Figure 4:
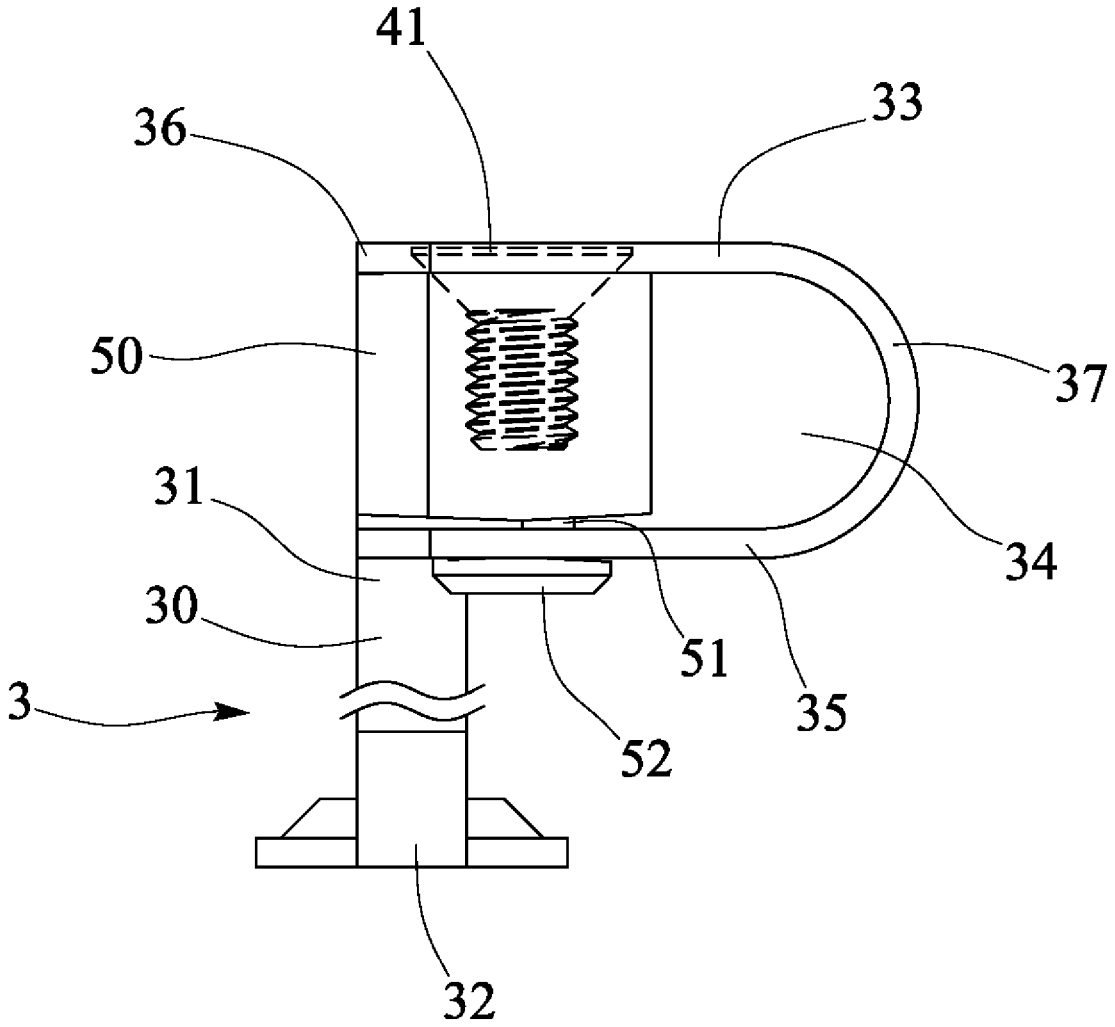
FIG. 4 is an end schematic view of the connecting cable device.
Figure 5:
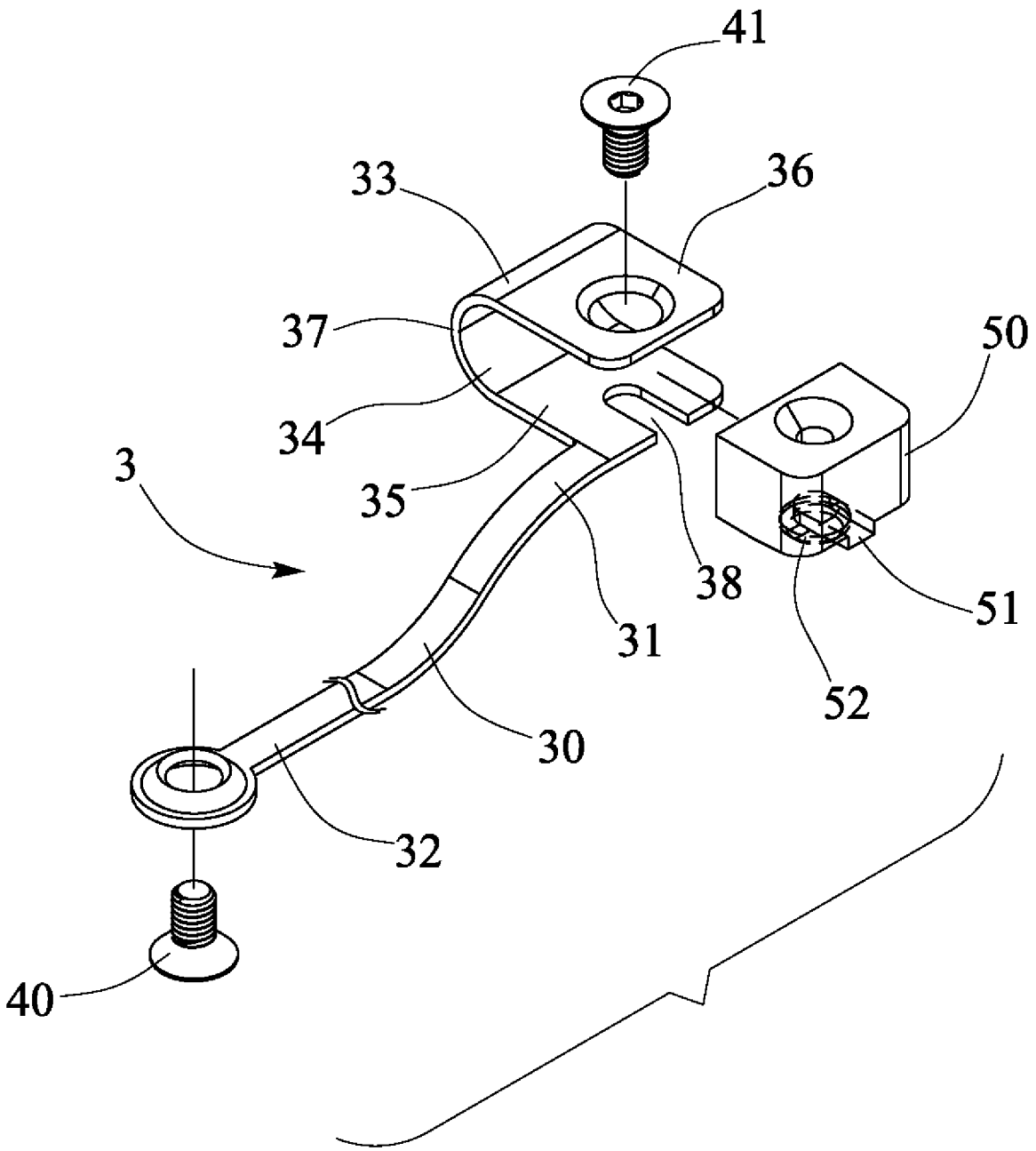
FIG. 5 is a partial exploded view as seen from one or upper or lower direction of the connecting cable device.
Figure 6:
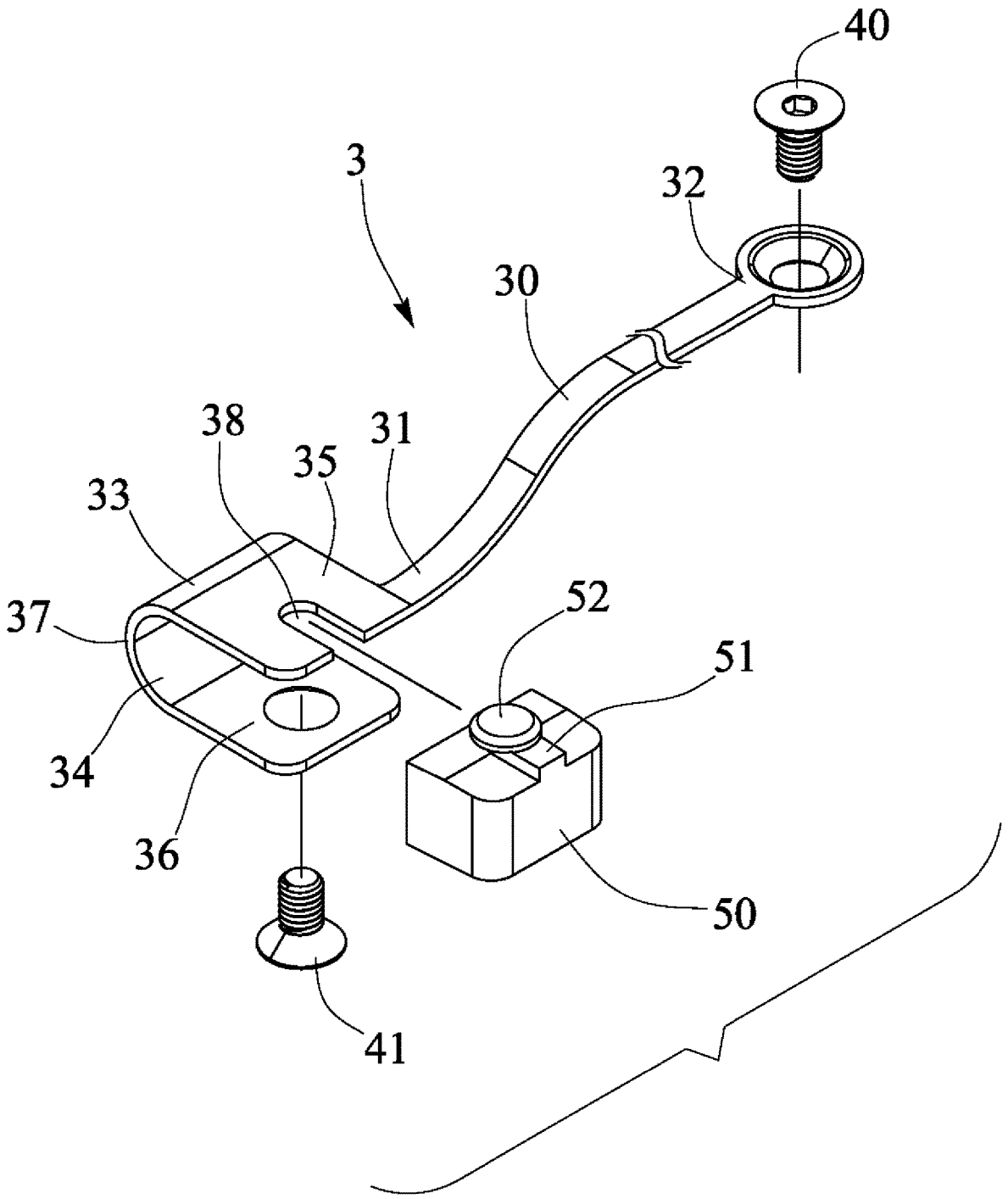
FIG. 6 is another partial exploded view as seen from the other or lower or upper direction of the connecting cable device.

An insert or block or blocking member 50 is engageable into the chamber 34 of the casing 33 (FIGS. 2-4) and disposed and located and spaced or separated from the intermediate wall 37 for enclosing the chamber 34 of the casing 33 and for engaging with the cable 10 and for solidly and stably anchoring or retaining or confining the cable 10 in the chamber 34 of the casing 33, and thus for preventing the cable 10 from being easily and quickly disengaged or separated from the casing 33, and thus for preventing the cable 10 from being easily and quickly stolen by the other unauthorized persons and the like.

The blocking member 50 includes a key or projection 51 extended therefrom for slidably engaging with or into the slot 38 of the casing 33 and for suitably and selectively anchoring or retaining or positioning the blocking member 50 to the casing 33 and for solidly and stably anchoring or retaining or confining the cable 10 in the chamber 34 of the casing 33, and further includes an enlarged protrusion or stop member 52 formed or provided thereon or extended therefrom and having a diameter, size or standard greater than that of the projection 51 and the slot 38 of the casing 33 for further suitably anchoring or retaining or positioning the blocking member 50 to the casing 33 and for preventing the blocking member 50 from being easily disengaged or separated from the casing 33.

Another fastener or locking or fastening element 41 may further be provided and engaged with the flap 36 of the casing 33 and the blocking member 50 for solidly and stably locking or fastening the blocking member 50 to the casing 33 and for preventing the blocking member 50 from being disengaged or separated from the casing 33.

In operation, as shown in FIGS. 1 and 2, the cable 10 may normally provided for connecting or coupling to various electrical apparatuses or facilities, such as personal computers, notebooks 80, docks, discs, mobile phones, portable phones, electric power reservoirs, or power sources, batteries, or the like, and the cable 10 may be engaged into the chamber 34 of the casing 33, the blocking member 50 may then be engaged into the chamber 34 of the casing 33 for solidly and stably anchoring or retaining or confining the cable 10 in the chamber 34 of the casing 33, and thus for preventing the cable 10 from being easily and quickly disengaged or separated from the casing 33, and thus for preventing the cable 10 from being easily and quickly stolen by the other unauthorized persons and the like. The fastening element 41 may fasten and lock the blocking member 50 to the casing 33 for preventing the blocking member 50 from being disengaged or separated from the casing 33, and the fastening member 40 may be engaged with the second end portion 32 of the elongated member 30 and also engaged with the supporting member 88 for fastening or locking the lock device 3 and thus the cable 10 to the supporting member 88.

Accordingly, the connecting cable device in accordance with the present invention includes one or more terminals or conductors or plugs attached or mounted or secured or coupled to the end portions of a cable for connecting or coupling to various electrical apparatuses or facilities or the electric power reservoirs or power sources or the like, and a lock device for fastening or locking the connecting cable device to the supporting member.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A connecting cable device comprising:

a cable including two connectors attached to two end portions of said cable respectively, and a lock device including:

an elongated member having a first end portion and a second end portion, a casing provided on said first end portion of said elongated member and having a chamber formed in said casing for receiving and engaging with said cable, a blocking member engaged into said chamber of said casing for enclosing said chamber of said casing and for engaging with said cable and for retaining said cable in said chamber of said casing, and a fastening element engaged with said casing and said blocking member for locking said blocking member to said casing and for preventing said blocking member from being disengaged from said casing.

2. The connecting cable device as claimed in claim 1, wherein said casing includes a base panel and a flap and an intermediate wall connected between said base panel and said flap for forming and defining said chamber in said casing, and said fastening element is engaged with said flap of said casing.

3. The connecting cable device as claimed in claim 2, wherein said base panel is connected to said first end portion of said elongated member.

4. The connecting cable device as claimed in claim 2, wherein said casing includes a slot formed in said base panel and directed and opened away from said intermediate wall.

5. The connecting cable device as claimed in claim 4, wherein said blocking member includes a projection extended therefrom for engaging with said slot of said casing and for anchoring said blocking member to said casing.

6. The connecting cable device as claimed in claim 5, wherein said blocking member includes a stop member extended from said projection, and stop member includes a standard greater than that of said projection and said slot of said casing for anchoring said blocking member to said casing.

* * * * *